US008142582B2

(12) United States Patent
Wilzbacher et al.

(10) Patent No.: US 8,142,582 B2
(45) Date of Patent: Mar. 27, 2012

(54) EXPLOSIVE FORMULATION

(75) Inventors: Dennis R. Wilzbacher, Evansville, IN (US); Michael L. Schiele, Evansville, IN (US); John C. Harman, Evansville, IN (US)

(73) Assignee: **Carbo*Prill, Inc.**, Evansville, IN (US)

( * ) Notice: Subject to any disclaimer, the term of this patent is extended or adjusted under 35 U.S.C. 154(b) by 1952 days.

(21) Appl. No.: 11/199,618

(22) Filed: Aug. 8, 2005

(65) Prior Publication Data

US 2007/0012387 A1 Jan. 18, 2007

Related U.S. Application Data

(60) Provisional application No. 60/599,653, filed on Aug. 9, 2004.

(51) Int. Cl.

| | |
|---|---|
| ***C06B 31/00*** | (2006.01) |
| ***C06B 31/28*** | (2006.01) |
| ***D03D 23/00*** | (2006.01) |
| ***D03D 43/00*** | (2006.01) |

(52) U.S. Cl. ..... 149/109.4; 149/45; 149/46; 149/109.2

(58) Field of Classification Search ..... 149/45, 149/46, 109.2, 109.4
See application file for complete search history.

(56) References Cited

U.S. PATENT DOCUMENTS 4,780,156 A * 10/1988 Sheeran et al. ..... 149/21
5,505,800 A 4/1996 Harries et al.

* cited by examiner

*Primary Examiner* — James McDonough
(74) *Attorney, Agent, or Firm* — Nixon & Vanderhye

(57) ABSTRACT

An explosive formulation used in blasting operations such as, but not limited to, mining operations and the like. The formulation is composed of a modified form of Ammonium Nitrate Fuel Oil (ANFO) explosives which have been modified by the incorporation of a solid fuel material. The formulation comprising a dry granular solid component, a liquid high-boiling point component of about 4% by weight, and a solid fuel material. The solid fuel material comprising vitrinite macerals, liptinite macerals, and inert macerals fusinite and semi-fusinite, and is characterized as (1) having a concentrate of liptinite that is higher than normal coals, and (2) having a concentrate of pseudovitrinite that is significantly lower than normal coals.

13 Claims, No Drawings

EXPLOSIVE FORMULATION

CROSS REFERENCES TO RELATED APPLICATIONS

U.S. Provisional Application for Patent No. 60/599,653, filed Aug. 9, 2004, with title "Explosive Formulation" which is hereby incorporated by reference. Applicant claims priority pursuant to 35 U.S.C. Par. 119(e)(i).

Statement as to rights to inventions made under Federally sponsored research and development: Not Applicable

BACKGROUND OF THE INVENTION

1. Field of the Invention

The present invention relates generally to the field of explosive compositions, and methods of making and using same. More particularly, the present invention is a multi-component explosive formulation which finds versatile use in blasting operations such as, but not limited to, mining operations and the like. Even more particularly, though not exclusively, the present invention relates to the manufacture and use of modified forms of Ammonium Nitrate Fuel Oil (ANFO) explosives which have been modified with the incorporation of a solid fuel material.

2. Brief Description of Prior Art

Blasting operations in quarry mining and open pit mining conventionally use ANFO as the explosive. ANFO is an appropriate mixture of ammonium nitrate and fuel oil. While ANFO remains a popular explosive in the industry, it has inefficiencies, and is relatively expensive due to continually rising costs of its components.

Thus, there remains a need in the art for other explosive formulations which are safer to use and less costly than the present explosive compositions. As will be seen from the subsequent description, the preferred embodiments of the present invention overcome shortcomings of the prior art.

SUMMARY OF THE INVENTION

The present invention provides a multi-component explosive formulation that is ANFO explosives which has been modified with the incorporation of a solid fuel material. The present formulation is characterized by lower velocity of detonation, provides results as good as or better than conventional explosives and is less expensive than presently available explosive compositions.

Specifically, the present invention comprises an admixture of ammonium nitrate and less than 4% by weight (decreased from the conventional 6% by weight) of fuel oil. The carbon molecules in the fuel oil that are chemically necessary for an optimum blast are replaced in the current formulation with a solid fuel material characterized as (1) having a concentration of liptinite that is higher than normal coals, and (2) having a concentration of pseudovitrinite that is significantly lower than normal coals.

BRIEF DESCRIPTION OF THE DRAWINGS

The present invention will be illustrated on the basis of the following description of a preferred embodiment thereof.

DESCRIPTION OF THE PREFERRED EMBODIMENT

In accordance with the present invention, an explosive formulation is disclosed. The present invention relates generally to a multi-component explosive formulation which finds versatile use in blasting operations such as, but not limited to, mining operations and the like. However, as will be understood, the formulation can be applied to other blasting operations. Specifically, it will be noted that the present invention relates to the application of modified forms of Ammonium Nitrate Fuel Oil (ANFO) explosives which have been modified by the incorporation of a solid fuel material. In the broadest context, the explosive composition of the present invention consists of components configured and correlated with respect to each other so as to attain the desired objective.

The present invention provides an explosive formulation consisting of at least three components: a dry granular solid component which is an oxidizer, a liquid high-boiling point fuel oil or diesel or the like, and a solid fuel material.

Each component of the composition of the invention is individually not an explosive. As such, each component can be handled, shipped and stored as either oxidizers or flammable materials. Such classifications are more easily and less expensively shipped than explosives. However, as will be understood, these components, when mixed, form an explosive formulation which finds versatile use in blasting operations such as, but not limited to, mining operations and the like.

The first component of the composition of this invention is a dry component, which is an oxidizing compound. The preferred oxidizer is ammonium nitrate that is manufactured and delivered as a coated spheroid or prill that is in a typical diameter of about 0.09 inches. The first component can be readily selected from among oxidizers conventionally used in the manufacture of explosive compositions to achieve desired properties.

The second component of the composition is a high-boiling point liquid component. In the preferred embodiment, the second component is a liquid fuel.

Conventional ANFO generally comprises a mixture of ammonium nitrate and 6% by weight of fuel oil. The current formulation comprises an admixture of the first dry component and less than 4% by weight of the liquid second component. As will be discussed, the carbon molecules contained in the fuel oil that are chemically necessary for an optimum blast are replaced in the current formulation with the composition's third component, a solid fuel material. As used herein, all weights and percent by weight are based on total weight of the formulation.

The second component can be readily selected from among high-boiling point liquid components conventionally used in the manufacture of explosive compositions to achieve desired properties.

The third component of the composition is a solid fuel material. The third component's main maceral component (approximately 75%) is vitrinite and also included are the liptinite macerals sporinite, cutinite and resinite. The inert macerals fusinite and semifusinite are also present in the third component. As used herein, the term maceral means those organic units that compose coal mass. As such, coal is composed of macerals which each have a distinct set of physical and chemical properties that control the behavior of coal.

The third component is further characterized as follows: (1) the amount of liptinite macerals, particularly cutinite, are higher than normal, and (2) almost no pseudovitrinite (structured coalified wood) is present in the third component. More particular, the normal amount of liptinite macerals in coal is between 5-15% by weight of the coal. In contrast, the amount of liptinite macerals in the third component is approximately 20%. The vitrinite group generally includes two sub-groups namely matrix vitrinite, also known as desmovitrinite, and pseudovitrinite, also known as telovitrinite. The normal amount of vitrinite macerals in coal is similar to the amount of vitrinite macerals in the third component, approximately 75% by weight. However, of the total 75% by weight of vitrinite macerals found in coal, the normal amount of sub-group pseudovitrinite present is between 25-35%. In contrast, of the total 75% by weight of vitrinite macerals in the third component, there is little trace, near zero, amount of pseudovitrinite present.

Acceptable specimens of the third component are found in the Friendsville Coal Seam at the base of the Mattoon Geological Formation and within the McLeansboro Group of the Missourian Series of the Pennsylvanian Geologic System of sedimentary rock of Southeastern Illinois. However, alternate solid fuel materials having the characteristics as described above can be used.

The inherent chemical and physical properties of the third component, as described and used with the first and second components, allows for blasting velocities that match or closely match the natural resonant frequencies of those materials being blasted thereby utilizing only the energy required to fragment and move the rock, and do so in a safer more efficient manner.

These components of the present formulation may be packaged in separate containers conventionally employed for the desired purpose. Mixing of the components can be accomplished using mixing means known in the art, and does not require mechanical agitation. As such, a motor-driven mixer is not required. Therefore, mixing these dry and liquid components to produce the explosive formulation can be accomplished just prior to the need for the explosive composition.

As discussed, the present invention comprises an admixture of the first component (the dry component) and less than 4% by weight of the liquid second component. The approximate 4% by weight in the present formulation represents a significant decrease in volume of the liquid component used when compared with the conventional 6% by weight use of prior art explosives. The carbon molecules in the second component chemically necessary for an optimum blast are replaced in the current formulation with the third component. Application of a lesser volume of the liquid second component as described reduces the cost of the present explosive formulation compared with presently available explosive compositions. Similarly, inclusion of the third component as discussed depletes the required volume of the first component which further reduces the cost of the present explosive formulation compared with presently available explosive compositions.

The blend ratio of the third component to ANFO is a calculation based on the estimated natural resonant frequency of the rock, shale or other material to be blasted. The third component can be blended in ranges of about 5% to 50% of the total weight of the formulation. The formulation is loaded and delayed, and the shot is initiated as the conventional ANFO method is known in the art.

Examples of the invention will now be given.

There were three components in the blasting agents used in the test, ammonium nitrate mixed with four percent fuel oil by weight (ANFO-4), raw third component material and air washed third component material. As described, ANFO with only four percent oil was used because the third component material provides additional fuel to the blasting agent mixture. The third component material samples were minus ⅜ inch in size. The blends for each test were made using a powder truck equipped with two separate product bins and augers. The auger speed under each bin could be varied to achieve the appropriate blend. During testing, the ANFO-4 was placed in one bin and the third component material was placed in the second bin. Material from each bin was augered to a series of common collection augers that mix the blasting agents as they were transferred to the blast hole.

All of the blast holes drilled for the testing were 9⅞ inches in diameter. On average the holes were 99 feet deep with 7 feet of backfill, 17 feet of stemming, and a 75 feet powder column. The ANFO-4 and washed third component material test holes were positioned in the first row along the highwall face so that if a misfire occurred there would be a minimal amount of material to re-shoot and move with a conventional shot. The raw third component material test holes were incorporated into a production shot and were placed in the first and second rows of the shot. The highwall face burdens ranged from 22 to 24 feet and all of the holes were spaced 24 feet apart. Each blast hole was initiated with a non-electric detonator and 16 ounce cast primer. The surface delay between holes ranged from 25 to 50 milliseconds with each blast having a 500 millisecond down-hole delay. The configuration of all the blast holes in the test is typical of the designs used in normal production shots.

Testing began with a 4-hole shot of 100% ANFO-4, followed by three 4-hole shots with blends of 9.1% washed third component material and 90.9% ANFO-4, 21.1% washed third component material and 79.9% ANFO-4, and 29.8% washed third component material and 70.2% ANFO-4. The remaining blends namely 38.2% washed third component material and 61.8% ANFO-4, 51% washed third component material and 49% ANFO-4, 14.9% raw third component material and 85.1% ANFO-4, 27.4% raw third component material and 82.6% ANFO-4, 41.6% raw third component material and 68.4% ANFO-4, 45.3% raw third component material and 54.7% ANFO-4, and 55.7% raw third component material and 44.3% ANFO-4 were tested with the 2-hole shots. Data collected from each shot was used to produce a velocity trace. The velocity of detonation can be calculated by picking two points on the trace or by regression analysis of the entire trace. In this test, regression analysis rather than point-to-point data was used because it is believed it more accurately represents the test results. Results from the ANFO-4, and raw and washed third component material blends are represented in the table below.

| | Average Blend | | | Detonation Velocities—R/W Regression Analysis | | | | |
|---|---|---|---|---|---|---|---|---|
| | % Washed Third | % Raw Third | | | | | | |
| Test No. | Component Material | Component Material | % ANFO4 | Hole #1 | Hole #2 | Hole #3 | Hole #4 | Average |
| 1 | 0.0% | | 100.0% | 12,960 | 12,086 | 13,006 | 12,283 | 12,584 |
| 2 | 9.1% | | 90.9% | 13,407 | 12,523 | 11,959 | 12,515 | 12,601 |

-continued

| Test No. | Average Blend: % Washed Third Component Material | Average Blend: % Raw Third Component Material | % ANFO4 | Detonation Velocities—R/W Regression Analysis: Hole #1 | Hole #2 | Hole #3 | Hole #4 | Average |
|---|---|---|---|---|---|---|---|---|
| 3 | 21.1% | | 78.9% | 12,962 | 12,598 | 11,503 | 12,471 | 12,384 |
| 4 | 29.8% | | 70.2% | 12,180 | 12,061 | 11,931 | 11,828 | 12,000 |
| 5 | 38.2% | | 61.8% | 11,425 | 10,725 | | | 11,075 |
| 5 | 51.0% | | 49.0% | | | 9,088 | 9,264 | 9,176 |
| 6 | | 14.9% | 85.1% | 13,006 | 13,629 | | | 13,318 |
| 6 | | 27.4% | 72.6% | 12,041 | 12,818 | | | 12,430 |
| 6 | | 41.6% | 58.4% | 10,859 | 11,485 | | | 11,172 |
| 6 | | 45.3% | 54.7% | 8,285 | 10,974 | | | 9,630 |

ANFO-4—The 100% ANFO-4 shot well and had an average velocity of detonation (VOD) of 12,584 fps. It was slightly underfueled and orange smoke was present at the end of the shot which is typical of that condition. The fragmentation and movement of shot rock was similar to production blasts using ANFO with 6% fuel. The ANFO-4 test was conducted to establish a bench mark velocity for subsequent shots.

Washed Third Component Material Blends—All of the washed blends tested shot well and had constant detonation velocities. There were no misfires. There was some white smoke or steam present and excess fuel continued to burn for an instant after the 51% blend was detonated. In all of the tests, the fragmentation and movement of shot rock was similar to production blasts using ANFO with 6% fuel oil although it appeared that there was a slight decrease in fragmentation and movement as the percentage of third component material exceeded 40%. As the percentage of third component material in the blend increased, the detonation velocity decreased. This relationship is almost linear. In general terms, a 1% increase in third component material decreased the VOD by 82 feet per second. The highest average velocity recorded was 12,601 fps for the 9.1% washed third component material and 78.9 ANFO-4 blend. The lowest was 9,176 fps for the 51% washed third component material and 49% ANFO-4 test.

Raw Third Component Material Blends—All of the raw third component material blends tested shot well and had constant detonation velocity. There were no misfires nor were there signs of incomplete combustion. The fragmentation and movement of shot rock were similar to the washed third component material results. As the percentage of raw third component material was increased, the detonation velocity decreased. On average, a 1% increase in third component material decreased the VOD by 122 feet per second which was higher than the washed third component material blends. The highest average velocity recorded was 13,318 fps for the 14.9% raw third component material and 85.1% ANFO-4 blend. The lowest was 8,361 fps for the 55.7% raw third component material and 44.3% ANFO-4 test.

Combined Results—The raw and washed third component material VOD test results were comparable. On average the raw third component material VOD's were slightly higher than the washed third component material's. This may have been due in part to the smaller size distribution of the raw third component material. 23.3% of the raw third component material was minus 28 mesh in size comparable to 8.1% for the washed third component material. The smaller size fractions are more readily consumed than larger third component material particles making the detonation process more efficient.

Not only does the formulation lower blasting costs, but application of the formulation produced comparable if not better fragmentation, with a higher effective casting of the blasted material. This results in safer mine conditions due to reduced flyrock occurrences.

Although the description above contains many specificities, these should not be construed as limiting the scope of the invention but as merely providing illustrations of some of the presently preferred embodiments of the invention. For example, the present formulation was described with particular reference to the use of modified ANFO explosives in rock blasting, however it is to be noted that the present invention is not limited to the production and use of this type of explosive, but rather the scope of the present invention is more extensive so as to also include materials, modifications and uses other than those specifically described.

Further, it will be obvious that embodiments described may be varied in many ways. Such variations are not to be regarded as a departure from the spirit and scope of the invention, and all such modifications as would be obvious to one skilled in the art are intended to be included within the scope of the present invention.

Thus the scope of the invention should be determined by the appended claims and their legal equivalents, rather than by the examples given.

We claim:

1. An explosive formulation comprising:
a dry granular solid component,
a liquid high-boiling point component, and
a solid fuel material,
wherein said solid fuel material contains a vitrinite maceral, liptinite maceral, and inert macerals fusinite and semifusinite, and wherein the amount of liptinite macerals is higher than normal, and wherein almost no pseudovitrinite is present in said solid fuel material.

2. The formulation as recited in claim 1, wherein the dry granular solid component is an oxidizer.

3. The formulation as recited in claim 2, wherein the oxidizer is ammonium nitrate.

4. The formulation as recited in claim 1, wherein the liquid component is a liquid fuel oil.

5. The formulation as recited in claim 4, wherein the amount of the liquid component is 4 weight percent.

6. The formulation as recited in claim 1, wherein the amount of the vitrinite maceral in said solid fuel material is about 75 weight percent.

7. The formulation as recited in claim 1, wherein said solid fuel material is present in the amount of about 5 to about 50 weight percent.

8. An explosive formulation comprising:
a dry granular solid oxidizer component,
a liquid high-boiling point component, and a solid fuel material, wherein said liquid component is present in said formulation in an amount of not more than 4% by weight and wherein said fuel material is coal containing vitrinite and liptinite macerals.

9. The formulation as recited in claim 8, wherein the oxidizer is ammonium nitrate.

10. The formulation as recited in claim 9, wherein the liquid component is a liquid fuel oil.

11. The formulation as recited in claim 10, wherein the amount of vitrinite macerals in said solid fuel material is about 75 weight percent of the solid fuel material.

12. The formulation as recited in claim 11, wherein said solid fuel material is present in the amount of about 5 to about 50 weight percent.

13. An explosive admixture comprising a dry granular solid oxidizer component, a liquid fuel oil component, and a solid fuel material, wherein said liquid fuel of is present in said admixture in an amount of not more than 4% by weight of the admixture and wherein said solid fuel material is coal containing vitrinite and liptinite materials.

* * * * *